US005941088A

United States Patent [19]

Kim

[11] Patent Number: 5,941,088

[45] Date of Patent: Aug. 24, 1999

[54] DEVICE FOR DRAINING WATER CREATED BY DEFROSTING SHOWCASE

[75] Inventor: Do-Gyung Kim, Kwangju, Rep. of Korea

[73] Assignee: Kwangju Electronics Co, Ltd, Kwangju, Rep. of Korea

[21] Appl. No.: 08/964,136

[22] Filed: Nov. 6, 1997

[30] Foreign Application Priority Data

May 21, 1997 [KR] Rep. of Korea ..... 97-11496

[51] Int. Cl.[6] ..... F25D 21/14

[52] U.S. Cl. ..... 62/286; 62/290

[58] Field of Search ..... 62/272, 285, 286, 62/288, 290, 291, 248

[56] References Cited

U.S. PATENT DOCUMENTS

| | | | |
|---|---|---|---|
| 1,975,337 | 10/1934 | Tinkey | 62/286 |
| 2,911,799 | 11/1959 | Guyton et al. | 62/248 |
| 3,102,654 | 9/1963 | Millman et al. | 62/285 |
| 3,479,948 | 11/1969 | Mathews | 62/285 |

*Primary Examiner*—William Doerrler
*Attorney, Agent, or Firm*—Staas & Halsey

[57] ABSTRACT

A device for collecting and draining water created by defrosting a showcase, including a driving means operated by input power; a plurality of water catch panels opened and closed by the driving means; a drainpipe connected to one end of the water catch panels for directing the flow of the water; and a bucket collecting the water moved through the drainpipe.

2 Claims, 7 Drawing Sheets

PRIOR ART

PRIOR ART

PRIOR ART

DEVICE FOR DRAINING WATER CREATED BY DEFROSTING SHOWCASE

BACKGROUND OF THE INVENTION

1. Field of the Invention

The present invention relates to a showcase in which objects, foodstuffs for sale and the like are placed for fresh storage. More particularly, it relates to a device for draining water created by defrosting a showcase, which has water catch panels opened to directly supply cool air to a shelf during operation of the showcase, and closed to prevent the water from dropping on articles for sale placed on the shelf during defrosting the showcase.

2. Description of the Prior Art

Referring to FIGS. 1 and 3, a showcase includes a main body 10; a refrigerating compartment 30 formed at the lower part inside of main body 10 via a first partition 20; a duct 50 formed at the rear part inside of main body 10 via a second partition 40; an upper chamber 70 formed at the upper part inside of main body 10 via a third partition 60; and a storage chamber 90 with a display device 80 in which articles are placed for looking at in a shop.

Refrigerating compartment 30 has a cooling unit 110 with an evaporator for producing cool air, and a first fan 120, a kind of compressor, for forcing the cool air, generated by cooling unit 110, into storage chamber 90 by way of duct 50. A second fan 130 is installed in upper chamber 70, and makes the cool air, migrating to the upper part of main body 10, flow into storage chamber 90 easily.

Display device 80 consists of a rectangular-shaped shelf 81 on which articles are placed for displaying; an article support member 82 provided on the forepart of shelf 81 to prevent the displayed articles from falling off shelf 81; a bracket 83 having an upper part joined to the bottom of shelf 81 for supporting, and a rear part connected to second partition 40.

Once power is applied to the showcase after putting articles on shelf 81, cooling unit 110 generates cool air, and this cool air flows to duct 50 by first fan 120. A part of the cool air that has been moved to duct 50 is output to storage chamber 90 through an opening (not shown), and the rest flows to upper chamber 70 and is supplied from the upper part of storage chamber 90 by second fan 130. The cool air, output to storage chamber 90, refrigerates the articles placed on shelf 81, simultaneously with circulating through display device 80, and then flows to the lower part of main body 10. The cool air enters refrigerating compartment 30, and is recooled, thus generating fresh cool air.

The conventional showcase does not have any device for draining water created by defrosting, and the water drops on the articles on shelf 81, thus ruining them.

This problem may be solved by removing articles that are once displayed on shelf 81 in the daytime, from the showcase in the night for defrosting. However, this also requires an extra refrigerating case that will have the custody of the articles put out of the showcase during defrosting, and running this showcase costs a lot of money.

In order to solve the above problem of the conventional art, the showcase of FIG. 3 was disclosed, and it has a water catch panel 200 mounted on storage chamber 90 under third partition 60 for collecting water created during defrosting. Water catch panel 200 is integrally formed to be of size the same as the length of each sidewall of main body 10. Since one end of water catch panel 200 is securely fixed to second partition 40, water generated by defrosting does not drop on the articles on shelf 81, and there is no need to have an extra refrigerating case. However, the cool air output from upper duct 70 is blocked by water catch panel 200 to raise the temperature around shelf 81 on which the articles are placed, so the articles cannot be kept fresh.

SUMMARY OF THE INVENTION

It is an objective of the present invention to provide a device for draining water created by defrosting a showcase, which has a plurality of water catch panels installed under a third partition of the showcase to be opened by a driving means during operation of the showcase to let cool air a heat exchanger directly reach a shelf on which articles are put, thus preventing temperature rise around the shelf and keeping the articles fresh longer.

It is another objective of the present invention to provide a device for draining water created by defrosting a showcase, that is formed in the showcase to be closed during defrosting the showcase to prevent water, created by defrosting, from dropping on articles placed on a shelf.

In order to obtain the above-mentioned objective of the present invention, there is disclosed a device for collecting and draining water created by defrosting a showcase, including driving means operated by input power; a plurality of water catch panels opened and closed by the driving means; a drainpipe connected to one end of the water catch panels for directing the flow of the water; and a bucket collecting the water moved through the drainpipe. The driving means includes an electric motor installed on a second partition of the showcase, and worm gears and a plurality of worms operated by the electric motor. A plurality of the water catch panels are each connected to the worms to slant by a given angle, and have one end connected to a fixing means to be joined to the second partition.

DETAILED DESCRIPTION OF THE PREFERRED EMBODIMENTS

Figure 1:
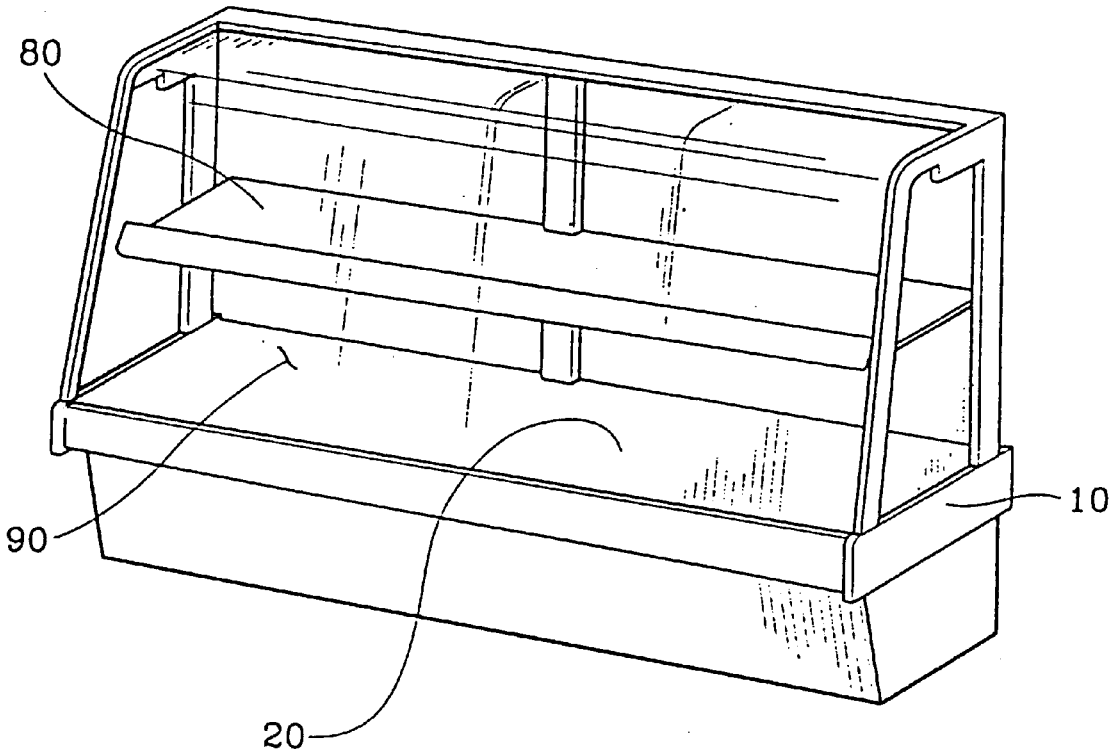
FIG. 1 is a perspective view of a conventional showcase.
Figure 2:
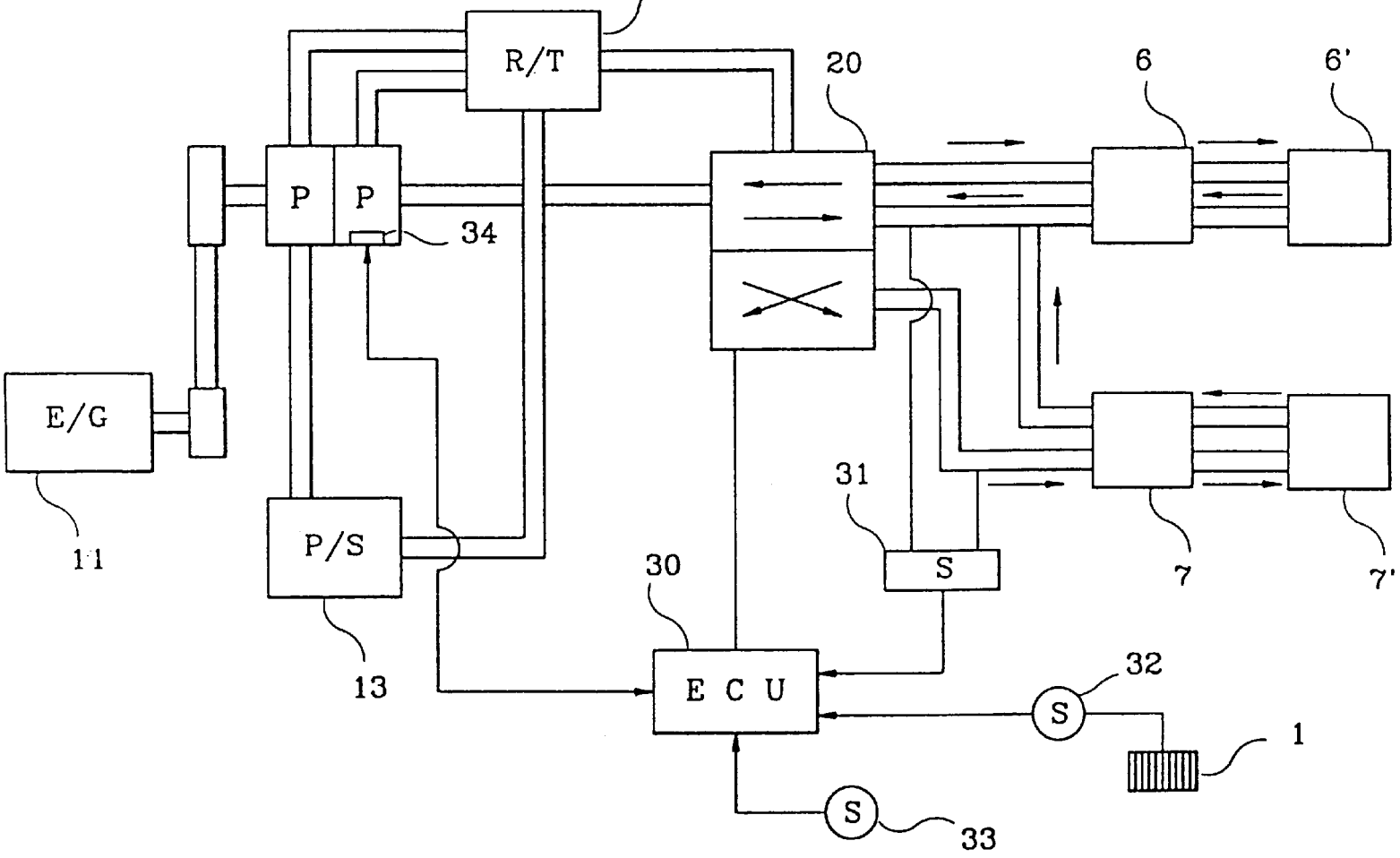
FIG. 2 is a longitudinal-sectional view of the conventional showcase without a device for draining water created by defrosting the showcase.
Figure 3:
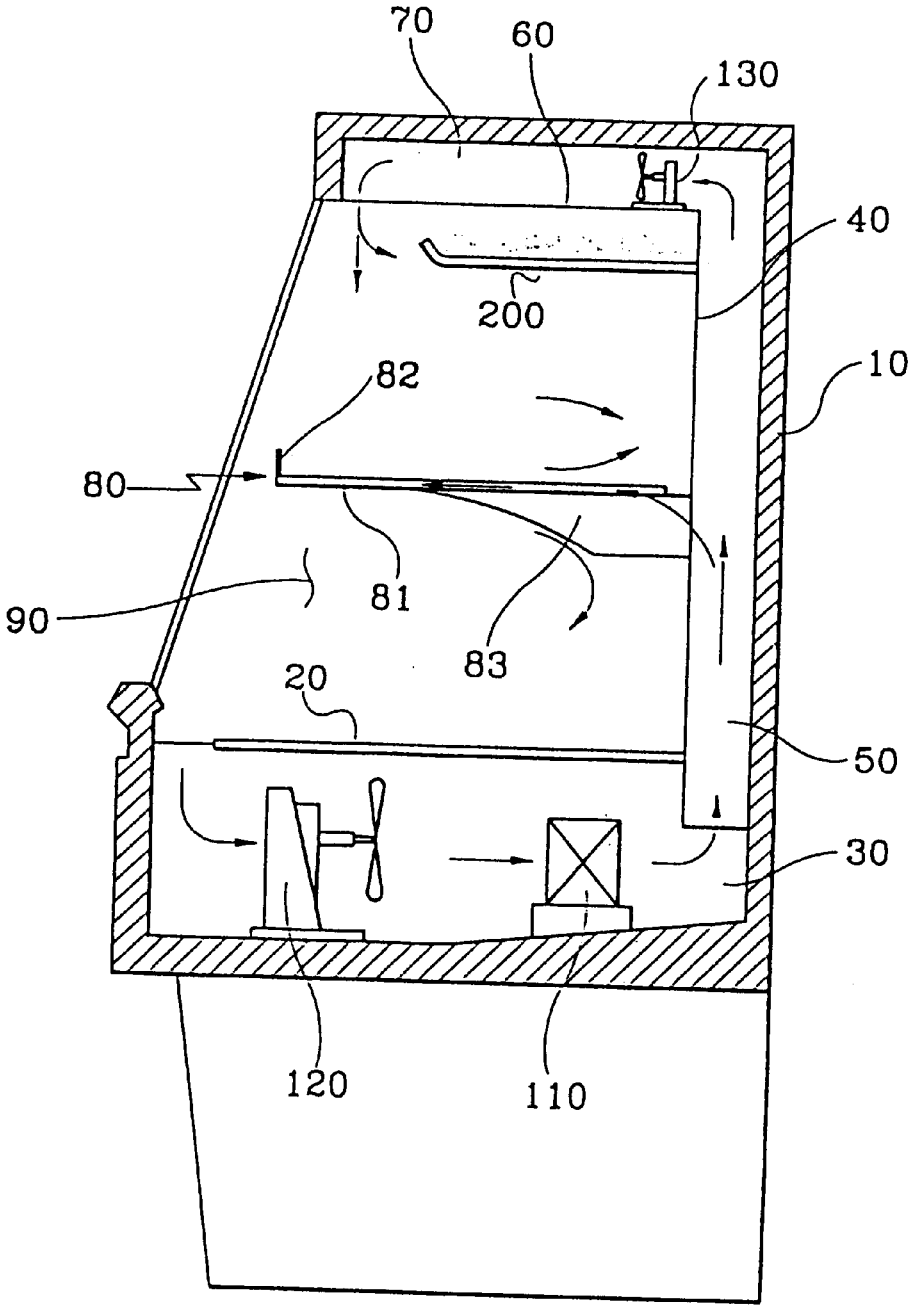
FIG. 3 is a longitudinal-sectional view of another conventional showcase with a water catch panel for collecting water created by defrosting.

Preferred embodiments of the present invention will be fully described referring to the accompanying drawings. Similar reference numerals denote similar reference parts throughout the specification and drawings.

Figure 4:
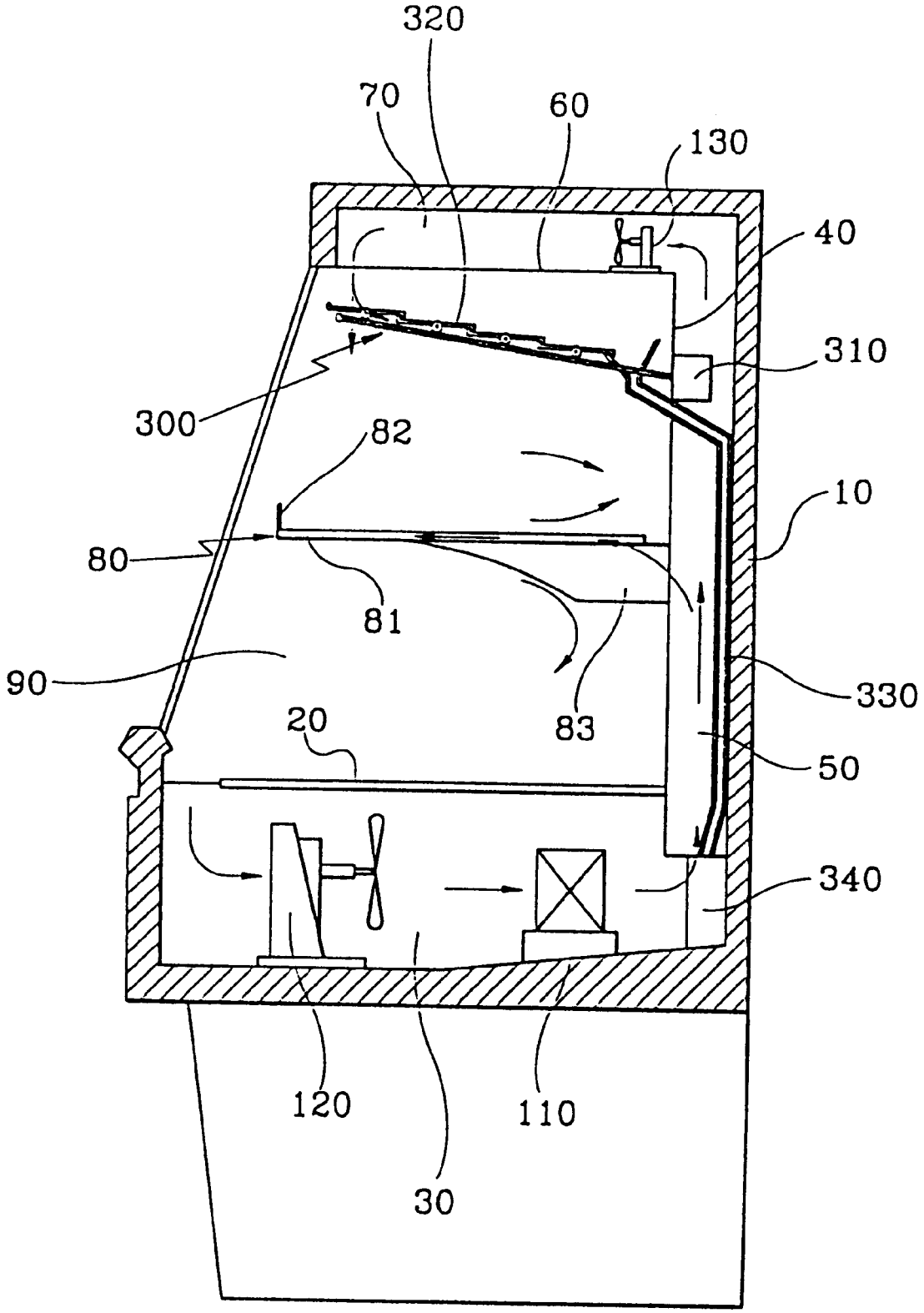
FIG. 4 is a longitudinal-sectional view of a showcase with a device for draining water created by defrosting in accordance with the present invention.

FIG. 4 is a longitudinal-sectional view of a showcase with a device for draining water created by defrosting the showcase in accordance with the present invention.

A showcase of the present invention includes a main body 10; a refrigerating compartment 30 formed at the lower part inside of main body 10 via a first partition 20; a duct 50 formed at the rear part inside of main body 10 via a second partition 40; an upper chamber 70 formed at the upper part inside of main body 10 via a third partition 60; and a storage chamber 90 with a display device 80 (shown in FIGS. 5 to 8) in which articles are placed for looking at in a shop.

Refrigerating compartment 30 has a cooling unit 110 with an evaporator for producing cool air, and a first fan 120 for forcing the cool air, generated by cooling unit 110, into storage chamber 90 by way of duct 50.

A second fan 130 is installed in upper chamber 70, and makes the cool air, migrating to the upper part of main body 10 through duct 50, flow into storage chamber 90 easily. Display device 80 consists of a rectangular-shaped shelf 81 on which articles for sale are placed for displaying; an article support member 82 provided on the forepart of shelf 81 to prevent the displayed articles from falling off shelf 81; a bracket 83 having an upper part joined to the bottom of shelf 81 for supporting, and a rear part connected to second partition 40.

A device 300 for draining water created by defrosting the showcase, installed in storage chamber 90, includes a driving means 310; a plurality of water catch panels 320 each opened and closed by driving means 310; a drainpipe 330 connected to one end of catch panels 320 for directing the flow of water; and a bucket 340 for collecting the water moved through drainpipe 330.

Figure 5:
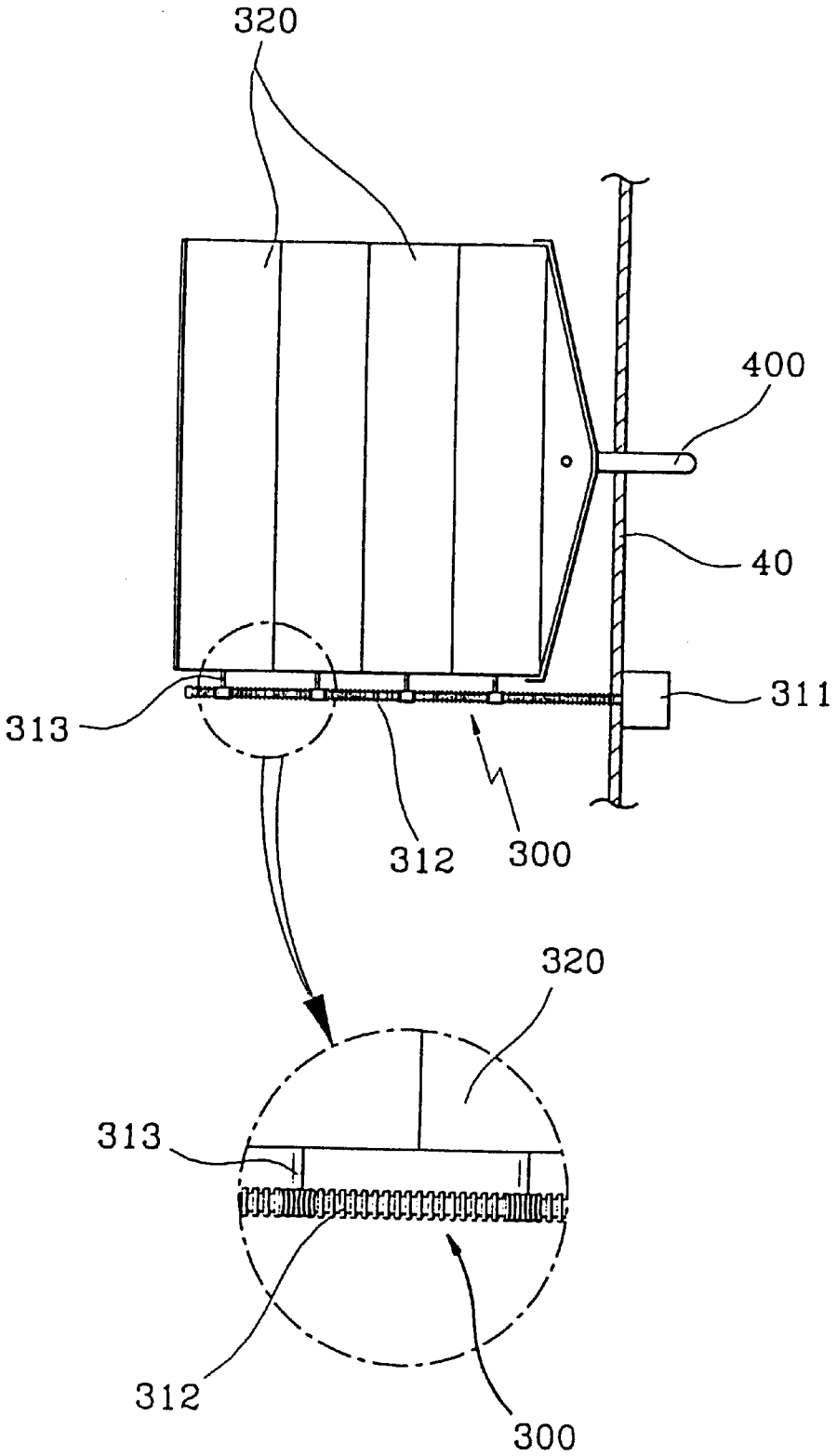
FIG. 5 is a plan view of a device for draining water created by defrosting the showcase in accordance with the present invention.
Figure 6:
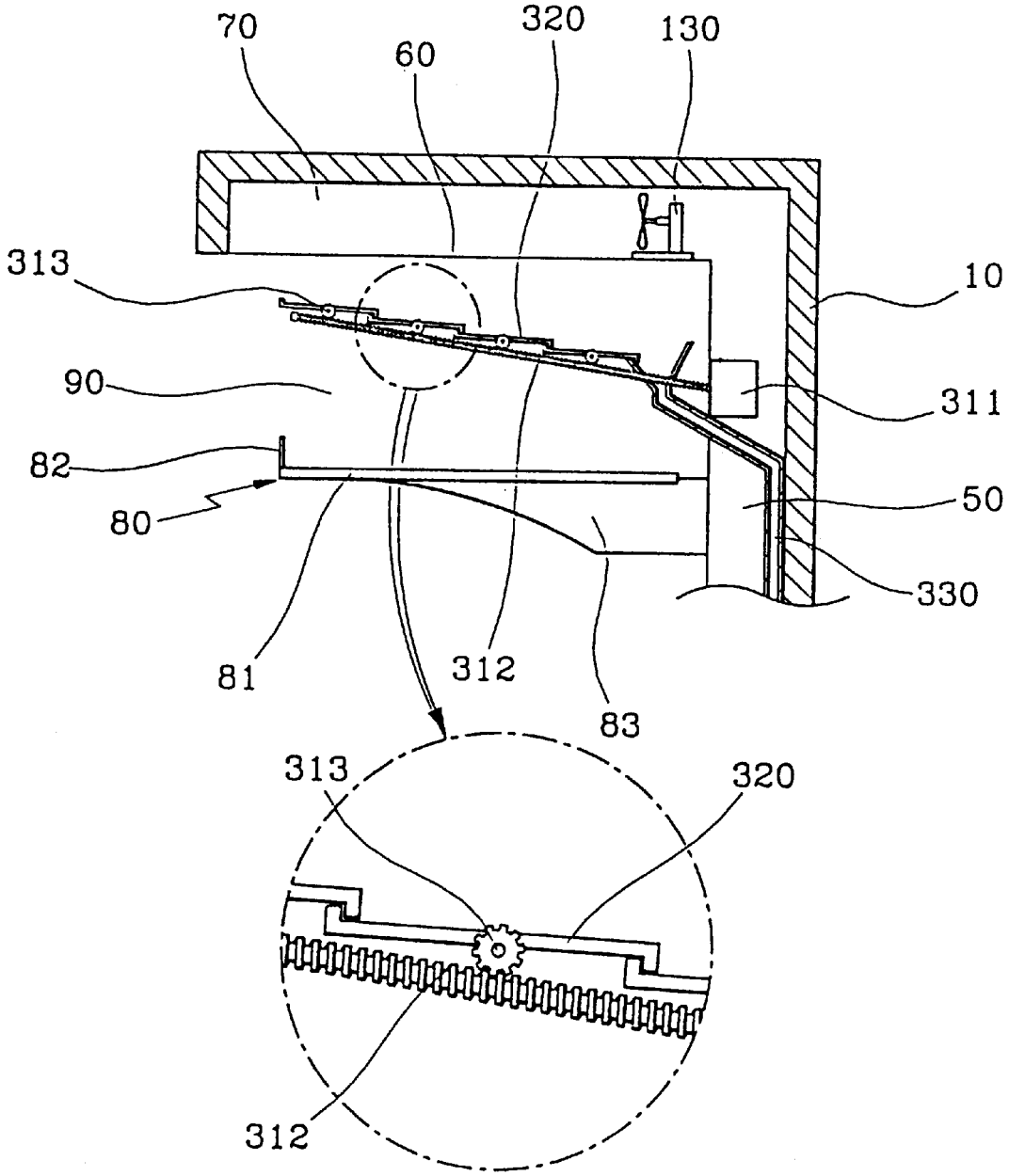
FIG. 6 is an enlarged view of main parts of FIG. 4.
Figure 7:
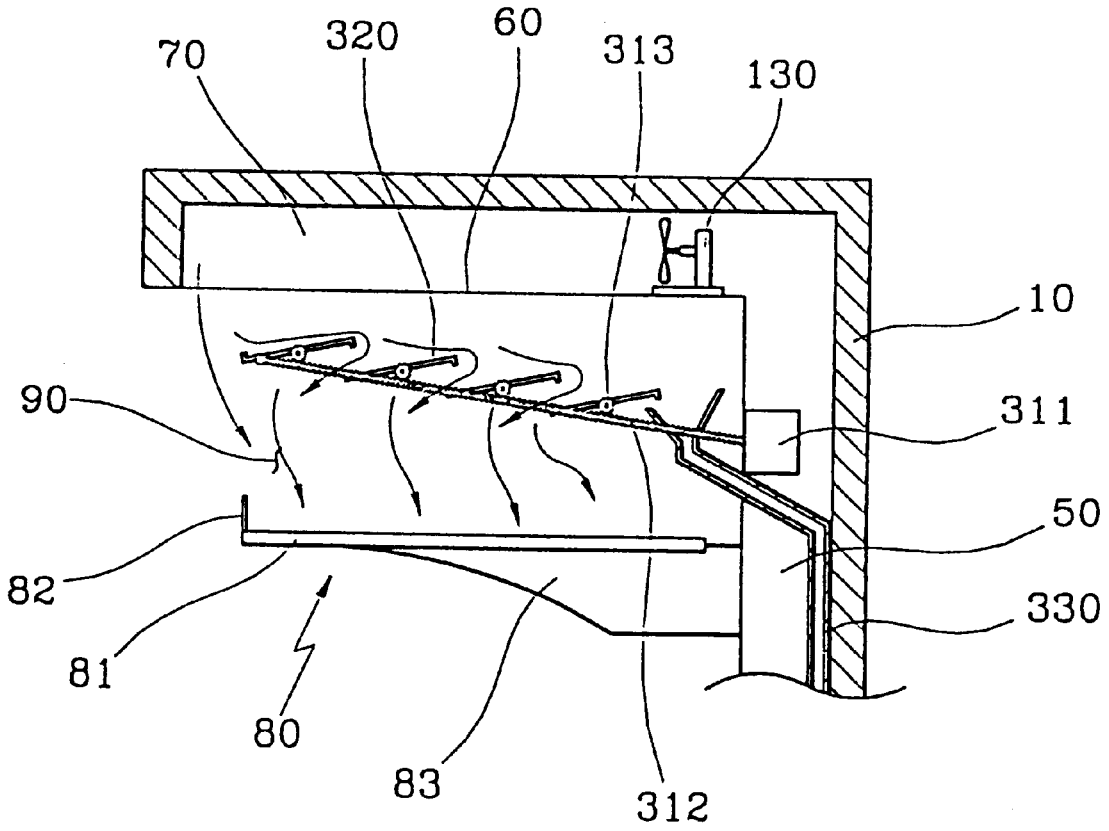
FIG. 7 is a longitudinal-sectional view for describing the operation of the device in accordance with the present invention.

As shown in FIGS. 5 and 6, driving means 310 consists of an electric motor 311 installed at the inner wall of the upper part of second partition 40, and a worm gear 312 with a plurality of worms 313, operating by electric motor 311. Water catch panels 320 are each connected to worms 313 to slant by a predetermined angle, and one end of them is connected to a fixing means 400, thus being joined to second partition 40.

The following description concerns the operation of the device for draining water created by defrosting the showcase in accordance with the present invention.

When power is applied to electric motor 311 of the showcase to drive it, worm gear 312 and worms 313 connected to electric motor 311 go into action. Simultaneously with rotating worms 313, each of water catch panels 320 turns to one side by a predetermined angle. The cool air output to storage chamber 90 from upper chamber 70 is supplied to articles, placed on shelf 81, through a gap between respective water catch panels 320 opened so that the articles for sale can be kept fresh longer.

In order to defrost the showcase, electric motor 311 is operated to close opened water catch panels 320 as shown in FIG. 6. The water, created by frosting and first collected in water catch panels 320, flows to drainpipe 330 along water catch panels 320. Finally, the water is collected in bucket 340 of FIG. 4.

Water catch panels 320 are separated from each other and opened via driving means 310 during operation of the showcase, thus making it easy to supply the cool air to the articles placed on shelf 81. When defrosting the showcase, water catch panels 320 are closed to prevent water created by defrosting from dropping on the articles for sale.

As described above, according to the present invention, a plurality of water catch panels are provided to the storage chamber of the showcase, and separated from each other and opened during operation of the showcase so that the cool air produced from the upper chamber is furnished to articles for sale placed on the shelf. In case of defrosting the showcase, the opened water catch panels are closed and stop the water, created by defrosting, from dropping on the articles, thus avoiding damage to them.

What is claimed is:

1. A device for collecting and draining water created by defrosting a showcase, said device comprising:

a driving unit operated by input power;

a plurality of water catch panels opened and closed by the driving unit;

a drainpipe connected to one end of the water catch panels to direct the flow of the water; and a bucket collecting the water moved through the drainpipe, wherein said driving unit includes:

an electric motor installed in a partition of the showcase; and worm gears and a plurality of worms operated by the electric motor.

2. A device, for collecting and draining water created by defrosting a showcase, said device comprising:

a driving unit operated by input power;

a plurality of water catch panels opened and closed by the driving unit;

a drainpipe connected to one end of the water catch panels to direct the flow of the water; and a bucket collecting the water moved through the drainpipe, wherein a plurality of the water catch panels are each connected to worms in order to allow said catch panels to slant by a given angle, and have one end connected to a fixing unit to be joined to a partition of the showcase.

* * * * *